US011832059B2

(12) United States Patent
O'Shaughnessy

(10) Patent No.: US 11,832,059 B2
(45) Date of Patent: Nov. 28, 2023

(54) HEARABLES AND HEARING AIDS WITH PROXIMITY-BASED ADAPTATION

(71) Applicant: SEMICONDUCTOR COMPONENTS INDUSTRIES, LLC, Phoenix, AZ (US)

(72) Inventor: Kyle James O'Shaughnessy, Mississauga (CA)

(73) Assignee: SEMICONDUCTOR COMPONENTS INDUSTRIES, LLC, Scottsdale, AZ (US)

( * ) Notice: Subject to any disclaimer, the term of this patent is extended or adjusted under 35 U.S.C. 154(b) by 0 days.

(21) Appl. No.: 17/669,164

(22) Filed: Feb. 10, 2022

(65) Prior Publication Data

US 2023/0254648 A1 Aug. 10, 2023

(51) Int. Cl.
*H04R 25/00* (2006.01)

(52) U.S. Cl.
CPC ..... *H04R 25/453* (2013.01)

(58) Field of Classification Search
CPC ..... H04R 25/00; H04R 25/453
See application file for complete search history.

(56) References Cited

U.S. PATENT DOCUMENTS 10,945,081 B2 3/2021 Shariati
11,503,415 B1 * 11/2022 Sorensen ..... H04R 25/505
2013/0021503 A1 1/2013 Zurek et al.
2013/0094668 A1 4/2013 Poulsen et al.
2016/0044437 A1 2/2016 Oishi et al.
2017/0078780 A1 3/2017 Qian et al.
2017/0094423 A1 3/2017 Neumeyer et al.
2017/0142527 A1 5/2017 Pedersen et al.
2022/0264231 A1 * 8/2022 Guo ..... H04R 25/453
2022/0312127 A1 * 9/2022 Sreepadarao ..... H04R 25/554
2022/0312129 A1 * 9/2022 Guo ..... H04R 25/505

OTHER PUBLICATIONS

Wikipedia, "Hearables," available at https://en.wikipedia.org/wiki/Hearables, as printed on Jan. 21, 2022, 7 pages.
Wikipedia, "Adaptive feedback cancellation," available at https://en.wikipedia.org/wiki/Adaptive_feedback_cancellation, as printed on Jan. 21, 2022, 4 pages.

* cited by examiner

*Primary Examiner* — Suhan Ni
(74) *Attorney, Agent, or Firm* — Ramey LLP; Daniel J. Krueger, Esq.

(57) ABSTRACT

An illustrative wearable hearing device or hearing aid includes: a speaker that converts a reproduced signal into reproduced audio; a microphone that converts ambient audio into a receive signal, the ambient audio potentially including a feedback component; a feedback filter that filters the reproduced signal to obtain an estimated feedback component; a combiner that derives the reproduced signal from the receive signal at least in part by subtracting the estimated feedback component; and a controller that, subject to an adaptation rate, adjusts coefficients of the feedback filter to at least partially cancel the feedback component, the controller varying the adaption rate based at least in part on one or more proximity sensor signals.

20 Claims, 3 Drawing Sheets

Fig. 1A
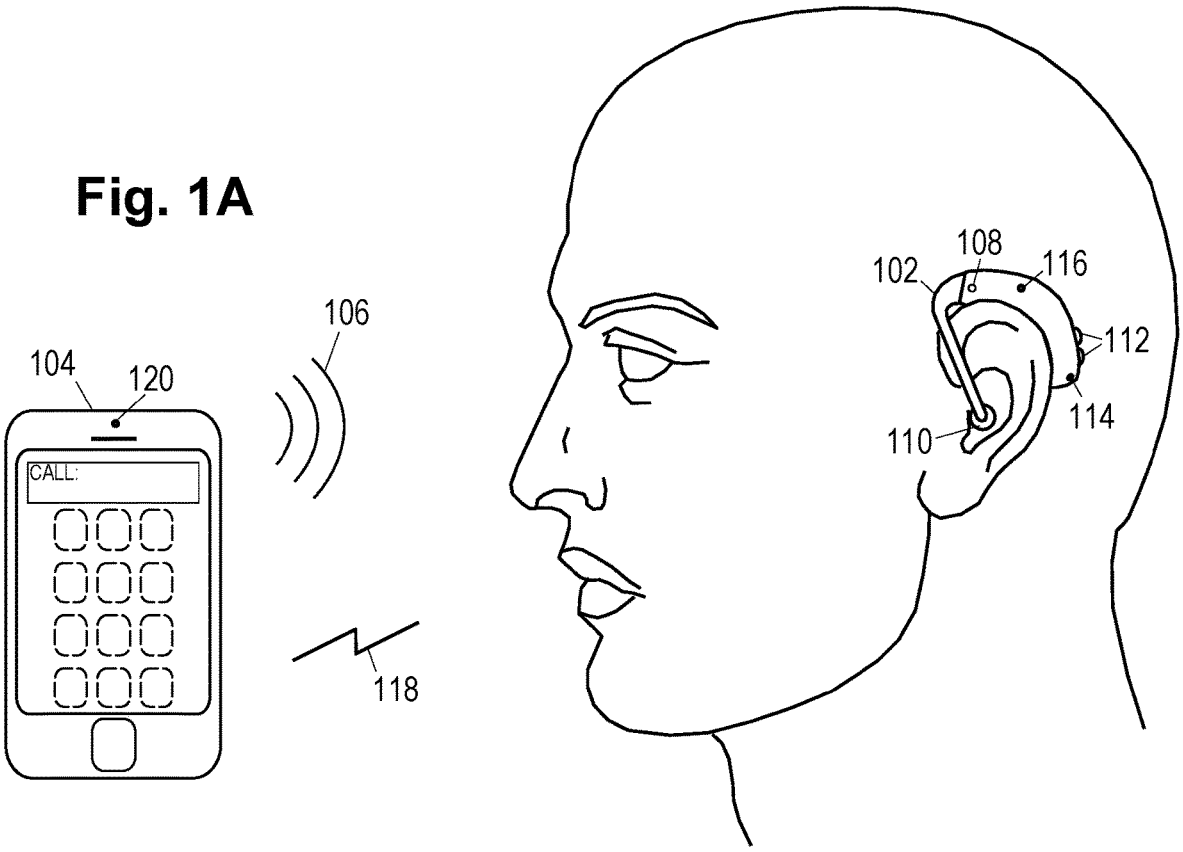
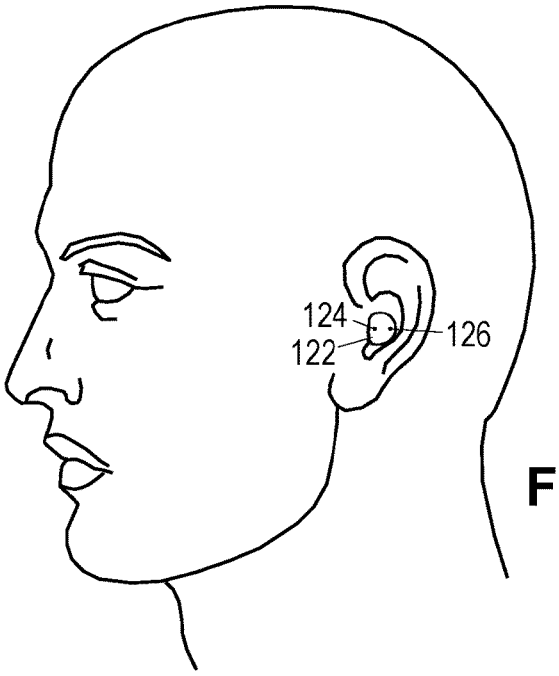
Fig. 1B

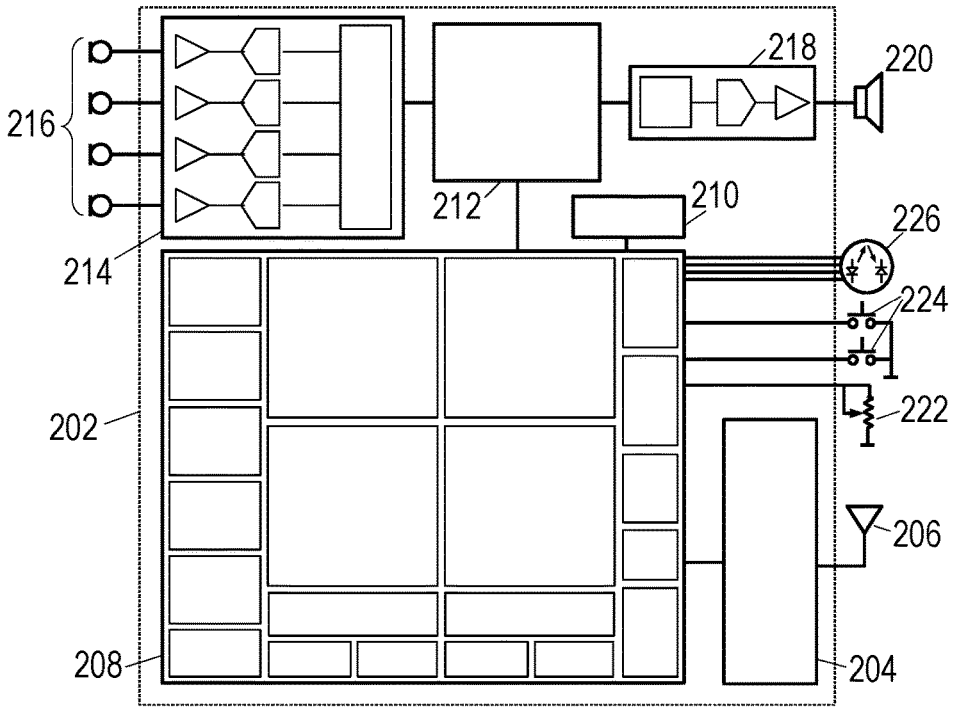
Fig. 2
Fig. 3
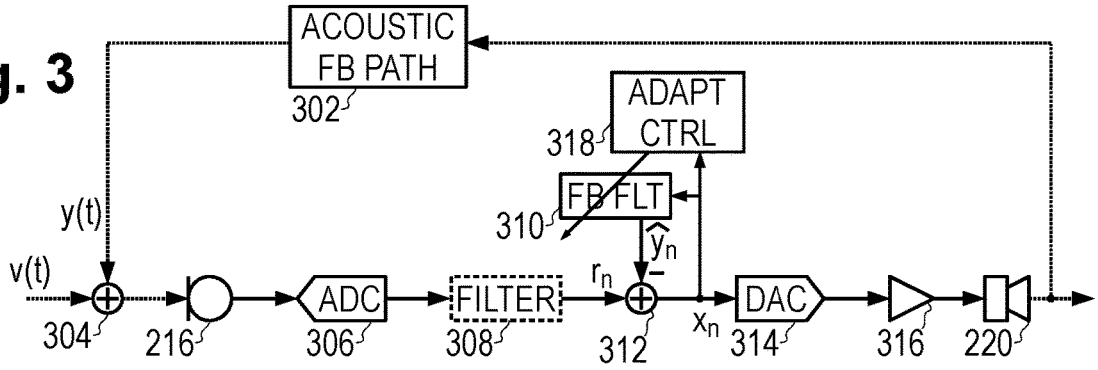

Fig. 4
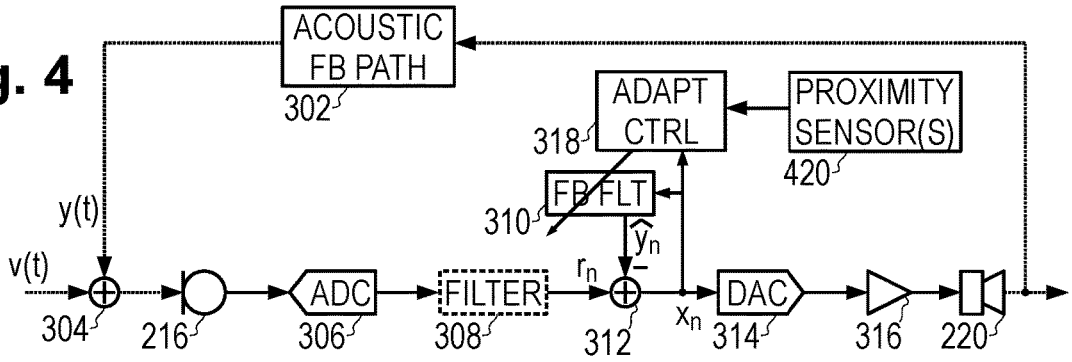
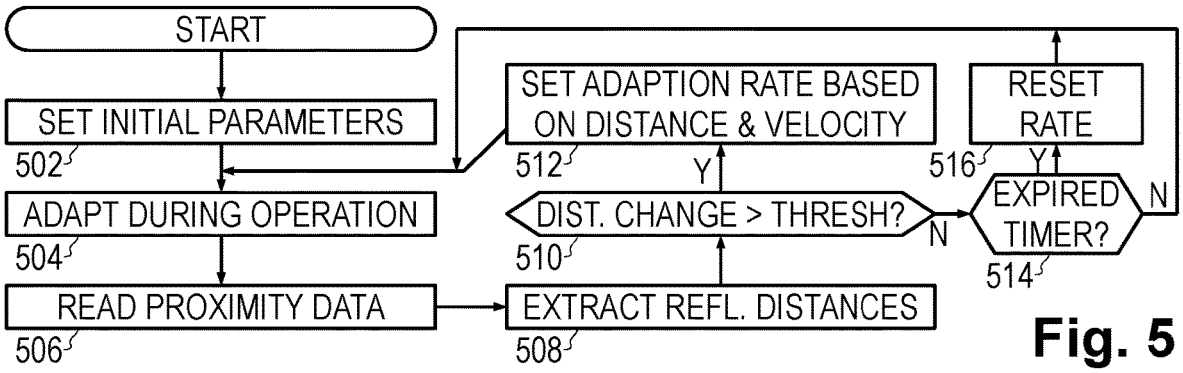
Fig. 5

HEARABLES AND HEARING AIDS WITH PROXIMITY-BASED ADAPTATION

BACKGROUND

As their name suggests, hearing aids are devices designed to compensate for hearing loss in patients. In many ways, they are similar to "hearables", a portmanteau of the words "headphone" and "wearable", which are wearable consumer devices with a speaker for providing an audio signal, and which are typically embodied as earbuds or similarly situated small devices that can be worn on or in the ear. Out of convenience or necessity, hearing aids and hearables generally include a microphone to capture the wearer's voice and/or ambient sounds. The microphone is often very near the speaker, making the device susceptible to feedback. While this vulnerability is particularly acute for hearing aids, which are designed to amplify ambient sounds, it remains a concern for hearables that base their generated audio signal in whole or in part on input from the microphone.

Acoustic Feedback occurs when the transfer function for the closed path including the forward path from microphone to speaker and the feedback path from speaker to microphone causes a phase shift of $2\pi k$ radians (k being an integer) for a given frequency with a positive gain (greater than 0 dB), thereby creating a self-sustaining oscillation at that frequency. Such feedback is typically perceived as a squeal or ringing which can be unpleasant and possibly damaging to a user's hearing.

For sufficiently long propagation delays, feedback can be perceived instead as an annoying echo. Acoustic echo is most typically encountered when a "near-end" device with a speaker and a microphone is used to communicate over a communication channel with a "far-end" device. If the acoustic feedback path on the near-end device is non-negligible, the audio transmitted from the far-end microphone will be echoed back to the far-end speaker. If the acoustic feedback path on the far-end device is non-existent, negligible, or effectively suppressed, the far-end user will hear a single repeated echo of their own ambient audio (i.e., double talk). If the far-end acoustic feedback path is non-negligible and the closed loop transfer function around both feedback paths does not meet the phase shift and gain conditions for feedback, both users may hear an echo repeated multiple times. If the far-end acoustic feedback path is non-negligible and the closed loop transfer function around both feedback paths does meet the conditions for feedback, a feedback squeal will be generated on both ends. However, generally communication systems are lower gain and do not risk generating feedback squeals.

The issues of acoustic feedback and acoustic echo can be addressed using textbook strategies for adaptive feedback cancellation and adaptive echo cancellation. A typical feedback/echo canceller uses an adaptive filter to model the transfer function of the acoustic feedback path, and with this model, derives an estimate of the feedback signal that can be subtracted from the audio captured at the microphone, thereby blocking (or at least reducing the effective gain of) the feedback path. (For clarity, the ensuing discussion at times refers to the non-feedback component of the audio captured at the microphone as the "desired signal".) In a feedback canceller, the subtraction must be sufficient to reduce the closed-loop gain to below 0 dB at all frequencies to suppress feedback squeals. In an echo canceller, the subtraction must be sufficient to suppress the echo to an unnoticeable level.

Feedback and echo cancellation strategies are adaptive because the characteristics of the feedback path generally vary with time. In a feedback canceller, adaptation that is overly aggressive can suppress or distort naturally autocorrelated components of the desired signal causing a range of audio artifacts collectively known as "entrainment". In some cases where highly autocorrelated components are captured, the adaptive filter coefficients can be driven far enough off course that the adaptive filter will actually add gain which may result in internally generated feedback. Conversely, adaptation that is overly restrained provides insufficient cancellation of the signal circulating through the feedback path, causing ringing. The adaptation rate should be chosen to be fast enough to accurately track variations in the feedback path and should be chosen to be slow enough to avoid suppressing or imparting entrainment effects onto highly autocorrelated components of the desired signal.

In an echo canceller, adaptation that is overly restrained provides insufficient cancellation of the signal passing through the feedback path, causing noticeable acoustic echo on the far-end of the communication channel. If adaptation is overly aggressive and the desired signal on the near-end device contains highly autocorrelated components (E.g., music and speech), the adaptive filter coefficients will be driven off course, which may lead to insufficiently suppressed echoes being transmitted back to the far-end.

Depending on the anticipated operating environment, the tradeoff between effects of overly aggressive adaptation rates and overly restrained adaptation rates can be difficult to balance, leading to poor performance and dissatisfied users.

SUMMARY

Accordingly, there are disclosed herein hearable devices and hearing aids with proximity-based adaptation. One illustrative wearable hearing device or hearing aid includes: a speaker that converts a reproduced signal into reproduced audio; a microphone that converts ambient audio into a receive signal, the ambient audio potentially including a feedback component; a feedback filter that filters the reproduced signal to obtain an estimated feedback component; a combiner that derives the reproduced signal from the receive signal at least in part by subtracting the estimated feedback component; and a controller that, subject to an adaptation rate, adjusts coefficients of the feedback filter to at least partially cancel the feedback component, the controller varying the adaption rate based at least in part on one or more proximity sensor signals.

An illustrative method for providing electronically assisted hearing includes: providing an output signal to a speaker that supplies amplified sound; receiving an input signal representing ambient audio that potentially includes a feedback component; using a feedback filter to obtain an estimated feedback component from the output signal; deriving the output signal from the input signal at least in part by subtracting the estimated feedback component; determining an adaptation rate of the feedback filter based at least in part on one or more proximity sensor signals; and adjusting coefficients of the feedback filter using the adaptation rate.

An illustrative controller for a wearable hearing device or hearing aid includes: a digital to analog converter that converts a digital output signal into an analog output signal for a speaker; an analog to digital converter that converts an analog input signal from a microphone into a digital input signal that potentially includes a feedback component; a feedback filter that filters the digital output signal to obtain an estimated feedback component; a combiner that derives the digital output signal from the digital input signal at least in part by subtracting the estimated feedback component; and an adaptation controller that, subject to an adaptation rate, adjusts coefficients of the feedback filter to at least partially cancel the feedback component, the adaptation controller varying the adaption rate based at least in part on one or more proximity sensor signals.

Each of the foregoing embodiments may be employed separately or conjointly, and may optionally include one or more of the following features in any combination: 1. the speaker and microphone are packaged within a body adapted to be worn on a human ear. 2. a wireless transceiver that communicates with a mobile device to obtain the one or more proximity sensor signals. 3. at least one proximity sensor packaged within said body to provide the one or more proximity sensor signals. 4. the controller uses the one or more proximity sensor signals to monitor at least one reflector distance, the controller temporarily raising the adaptation rate if the at least one reflector distance changes by more than a predetermined threshold. 5. the controller uses the one or more proximity sensor signals to monitor a velocity component of at least one reflector, the controller raising the adaptation rate when the velocity component exceeds a predetermined threshold and lowering the adaptation rate when the velocity component falls below the predetermined threshold. 6. the controller varies the adaptation rate based at least in part on distance and/or velocity data of one or more reflectors. 7. the controller derives the distance and/or velocity data using array processing or directional beamforming from multiple proximity sensors. 8. the controller varies the adaptation rate by varying a parameter for calculating updated coefficients. 9. the parameter is a forgetting factor. 10. the parameter is a convergence factor.

BRIEF DESCRIPTION OF THE DRAWINGS

FIG. 1A is an environmental view of an illustrative hearing aid.

FIG. 1B is an environmental view of an illustrative hearable device.

FIG. 2 is an integrated circuit layout diagram of an illustrative hearing aid or hearable device.

FIG. 3 is a signal flow diagram for a first illustrative hearing aid or hearable device.

FIG. 4 is a signal flow diagram for an illustrative improved hearing aid or hearable device.

FIG. 5 is a flow diagram for an illustrative method for providing assisted hearing.

DETAILED DESCRIPTION

The attached drawings and following description set out particular embodiments and details for explanatory purposes, but it should be understood that the drawings and corresponding detailed description do not limit the disclosure. On the contrary, they provide a foundation that, together with the understanding of one of ordinary skill in the art, discloses and enables all modifications, equivalents, and alternatives falling within the scope of the appended claims.

FIG. 1A is an environmental view of an illustrative hearing aid device 102. Device 102 is a hearing aid configured to be worn on a user's ear. It operates to receive, process, and amplify voices and other ambient acoustic audio to compensate a user's hearing impairment. FIG. 1 further illustrates a mobile device 104 delivering an acoustic signal 106 to the user. The hearing aid device 102 employs one or more microphones 108 to capture the ambient acoustic audio, and an in-ear speaker 110 to reproduce the acoustic signal in processed/amplified form, directing it into the user's ear canal. The processing is not limited to just amplification; rather it may include range compression, equalization, noise reduction, de-reverberation, and other such techniques for improving sound quality. Often the hearable aid device 102 includes a set of buttons or other controls 112 enabling the user to control the volume, on/off status, and other operating parameters of the hearable aid device.

As mentioned in the background section, sound from the speaker 110 can reach the nearby microphone(s) 108, potentially providing a path for echo or feedback effects. The presence of nearby surfaces, particularly those that may be acoustically reflective, can further facilitate sound propagation from the speaker 110 to the microphone(s) 108. As one example, a user moving their hand to the controls, or lifting their mobile device to their ear, could inadvertently provide an acoustic reflector that more strongly couples the speaker output to the microphone, heightening the probability of a loud squeal or a similarly unpleasant feedback or echo effect. So long as the user moves slowly enough, the chosen feedback cancellation strategy can usually prevent such unpleasantness. It is often the case, however, that a user's normal speed would exceed what can be handled by a cancellation strategy that employs an otherwise desirable adaptation rate. Even in situations where the user doesn't move, changes can occur to the feedback path that might induce feedback effects, e.g., somebody else moving past or coming close to the user.

Accordingly, it is proposed herein to employ proximity sensors, either on the body of the hearing device 102 (e.g., proximity sensors 114, 116), or sensors accessible via a wireless link 118 (e.g., a proximity sensor 120 on mobile device 104). Other potential proximity sensor positions include wrist watches, rings, bracelets, earrings, and other jewelry able to be outfitted with the necessary electronics. A wide variety of suitable proximity sensors are known and available, including capacitive sensors, inductive sensors, and pulse-echo type sensors using ultrasonic or IR energy. Multiple sensors may be configured as an array for directional sensing via triangulation or beamforming. Sensor placement close to the microphone cavity(s) may provide for better measurement correlation with the acoustic coupling paths. Some implementations may provide sensors positioned on different faces of the device or otherwise oriented in different directions to more completely monitor the acoustic space around the device.

Proximity sensors can quickly detect the presence and/or motion of objects having the potential to change the speaker-microphone acoustic coupling and temporarily increase or otherwise modulate the adaptation rate to enable proper functioning of the chosen feedback cancellation strategy. Once the objects stop moving or the acoustic coupling stabilizes in some other fashion, the adaptation rate can be restored to a more desirable value that avoids distortion.

Though a hearing aid has been used as an example in the foregoing disclosure, similar principles apply to earbuds, headsets, and headphones that sense ambient audio for noise cancellation or more selective enhancement of music or other content being delivered to the user's ear canals. As another example, FIG. 1B shows an illustrative in-ear wearable hearing device 122 having one or more microphones 124 to capture ambient acoustic audio, an in-ear speaker (not visible here), and one or more proximity sensors 126.

FIG. 2 is a block diagram of an illustrative hearing aid or hearable device 202 that supports the use proximity-sensor based feedback and echo cancellation strategies. The device may be a hearing aid, earbud, headset, or other wearable device. Device 202 typically includes a radio frequency (RF) module 204 (at times referred to as a radio module) coupled to an antenna 206 to send and receive wireless communications. The radio module 204 is coupled to a controller 208 that employs it to transmit and receive wireless control communications and wireless streaming communications. Controller 208 extracts digital signal data from the wireless streaming packets received by radio module 204, optionally buffering the digital signal data in system memory 212. The digital signal data may include streaming music or other audio content for conversion to in-ear sound.

The controller 208 is preferably programmable, operating in accordance with firmware stored in a nonvolatile memory 210. A volatile system memory 212 may be employed for digital signal processing and buffering.

A signal detection unit 214 collects, filters, and digitizes signals from local input transducers 216 (such as a microphone array). The detection unit 214 further provides direct memory access (DMA) transfer of the digitized signal data into the system memory 212, with optional digital filtering and down sampling. Conversely, a signal rendering unit 218 employs DMA transfer of digital signal data from the system memory 212, with optional up sampling and digital filtering prior to digital-to-analog (D/A) conversion. The rendering unit 218 may amplify the analog signal(s) and provide them to local output transducers 220 (such as one or more speakers). Noise and feedback cancellation may be implemented by the rendering unit 218 and/or by controller operations on buffered signal data in memory 212.

Controller 208 may further include general purpose input/output (GPIO) pins to measure the states of control potentiometers 222 and switches 224, and to obtain measurement data from proximity sensors 226. The controller 208 may use those states and measurements to provide for manual or local control of on/off state, volume, filtering, and other rendering parameters.

At least some contemplated embodiments of controller 208 include a RISC processor core, a digital signal processor core, special purpose or programmable hardware accelerators for filtering, array processing, and noise cancelation, as well as integrated support components for power management, interrupt control, clock generation, and standards-compliant serial and parallel wiring interfaces. The software or firmware stored in memories 210, 212, may cause the processor core(s) of the controller 208 to implement a proximity-based noise or feedback cancellation strategy as described below.

FIG. 3 shows an illustrative signal flow that may be implemented by a hearing aid or hearable device having feedback cancellation. Sound from a speaker 220 is acoustically coupled to a microphone 216 via a feedback path 302. Summer 304 represents the additive contributions of the feedback component y(t) and the ambient sound v(t) to the signal received by the microphone 216. Analog-to-digital converter 306 digitizes the receive signal, followed by an optional filter 308 to obtain digital receive signal $r_n$. (Filter 308 may be used to provide spectral shaping, signal to noise ratio enhancement functions and compression.) A finite impulse response (FIR) feedback filter 310 derives an estimated feedback component $\hat{y}_n$ from output signal $x_n$. A signal combiner 312 subtracts the estimated feedback component $\hat{y}_n$ from the receive signal $r_n$ to obtain the digital output signal $x_n$. A digital to analog converter 314 converts the digital output signal to an analog output signal x(t). An amplifier 316 supplies an amplified version of the output signal to the speaker 220, which converts the analog output signal into sound.

Feedback filter 310 is adaptive, meaning that its coefficients can be adjusted. For example, the coefficients may be adjusted to minimize the average energy of the output signal (a consequence of eliminating the feedback component from the receive signal). An adaptation control module 318 updates the filter coefficients using any suitable adaptation method such as those described in Simon Haykin's *Adaptive Filter Theory* textbook including, e.g., Least-Mean-Square Algorithm, Recursive Least-Squares Algorithm. Typically, updated filter coefficients are calculated as a weighted sum of their prior value and an "update" amount.

Often, the weighted sum includes a convergence factor, i.e., a multiplier used to scale the update amount and thereby increase or decrease the adaptation rate. A larger convergence factor enables faster accommodation of changes to the feedback channel, usually at the cost of less accurate cancellation. A smaller convergence factor slows the adaptation rate, but typically offers better cancellation performance. In many implementations, the weighted sum also includes a forgetting factor, i.e., a multiplier used to scale the prior value and thereby moderate the influence of past updates. Thus, the adaptation rate can also be increased or decreased by adjusting the forgetting factor.

Convergence factor and/or forgetting factor values that favor more accurate feedback cancellation (at the cost of slower adaptation rates) may be preferred in most circumstances but may be inadequate to deal with quickly changing acoustic couplings between the speaker and microphone, such as those due to a user's hand, mobile device, or other object passing close to the hearable device. To address this issue, the signal flow diagram may be modified as shown in FIG. 4. More specifically, the adaptation control module 318 may be coupled to one or more proximity sensors 420 to monitor distances or velocities of nearby objects. Even where absolute distances or velocities are unavailable (e.g., with most inductive or capacitive sensors) the amplitude or derivative of the sensor signal may be compared with predetermined thresholds to detect when significant changes are occurring within the vicinity of the hearable device. When such changes are detected, the adaptation control module 318 may temporarily increase the adaptation rate to enable faster tracking by the adaptive filter. Thereafter the adaptation control module can revert the adaptation rate to the preferred value. It is expected that the duration of the temporary increase would be in the 500 to 2000 millisecond range.

FIG. 5 is an illustrative flow diagram of an adaptation control method suitable for the controller 208 to implement. In block 502, the controller sets the initial filter coefficients and adaptation parameters to default values., e.g., values that provide a conservative or intermediate adaptation rate. In block 504, the controller determines and applies the update amounts for the adaptive filter coefficients. In block 506, the controller obtains proximity data from the proximity sensor (s), deriving distances to nearby objects that might cause increased acoustic coupling between the speaker and microphone in block 508. In block 510, the controller compares the distances to previous values to detect whether one or more of the distances has changed by an amount that exceeds a predetermined threshold. The threshold may be calculated based on amounts or velocities where the feedback filter may be expected to exhibit performance degradation using the default adaptation rate. Alternatively, a suitable threshold may be determined experimentally.

When the proximity data indicates a significant distance change to a nearby object, the controller in block 512 temporarily increases the adaptation rate. The adaptation rate may be set to a predetermined higher value, or set to a value that corresponds to the amount by which the change exceeds the predetermined threshold. The controller may initiate a timer when increasing the adaptation rate. The controller then repeats blocks 504-510.

When the proximity data indicates no significant distance change has occurred, in block 514 the controller determines whether the timer has expired. If not, blocks 504-510 are repeated. If so, the controller then resets the adaptation rate back to the default value in block 516 before repeating blocks 504-510.

The temporary rate-switch method of FIG. 5 is just one example. Other contemplated methods include employing a continuously variable adaptation rate (or at least a more graduated series of adaptation rates) that can be set based on the measurements of the proximity sensor(s). As an example, the adaptation rate may be set proportionate to the highest velocity being detected by the proximity sensor(s), inversely proportionate to the distance to the nearest moving reflector, or some combination thereof. In another contemplated embodiment, the one or more proximity detectors are configured to provide direction-dependent distance or velocity measurements. It is expected that changes to the transfer function of the feedback path will be more sensitive to motion on the side of the user's head and less sensitive to changes frontward or rearward of the user's head, and the adaptation rate may be adjusted accordingly.

Because the proximity sensors provide a way of monitoring for sudden changes to the speaker-microphone coupling, the controller need not rely on the receive signal itself to detect and address such changes. Where the controller can obtain the proximity data from already existing sensors (e.g., those in a user's mobile device, or sensors in hearables with gesture detection features), enhanced performance can be achieved via firmware revisions with no added manufacturing cost. For minimal additional cost, commercially available proximity sensors can be readily integrated into existing hearable device designs.

Any of the controllers described herein, or portions thereof, may be formed as a semiconductor device using one or more semiconductor dice. Though the operations shown and described in FIG. 5 are treated as being sequential for explanatory purposes, in practice the method may be carried out by multiple integrated circuit components operating concurrently and perhaps even with speculative completion. The sequential discussion is not meant to be limiting. These and numerous other modifications, equivalents, and alternatives, will become apparent to those skilled in the art once the above disclosure is fully appreciated. It is intended that the following claims be interpreted to embrace all such modifications, equivalents, and alternatives where applicable.

It will be appreciated by those skilled in the art that the words during, while, and when as used herein relating to circuit operation are not exact terms that mean an action takes place instantly upon an initiating action but that there may be some small but reasonable delay(s), such as various propagation delays, between the reaction that is initiated by the initial action. Additionally, the term "while" means that a certain action occurs at least within some portion of a duration of the initiating action. The use of the words approximately or substantially means that a value of an element has a parameter that is expected to be close to a stated value or position. The terms first, second, third and the like in the claims or/and in the Detailed Description or the Drawings, as used in a portion of a name of an element are used for distinguishing between similar elements and not necessarily for describing a sequence, either temporally, spatially, in ranking or in any other manner. It is to be understood that the terms so used are interchangeable under appropriate circumstances and that the embodiments described herein are capable of operation in other sequences than described or illustrated herein. Reference to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment, but in some cases it may. Inventive aspects may lie in less than all features of a single foregoing disclosed embodiment. Furthermore, while some embodiments described herein include some, but not other features included in other embodiments, combinations of features of different embodiments are meant to be within the scope of the invention, and form different embodiments, as would be understood by those skilled in the art.

What is claimed is:

1. A wearable hearing device or hearing aid device that comprises:

a speaker that converts a reproduced signal into reproduced audio;

a microphone that converts ambient audio into a receive signal, the ambient audio potentially including a feedback component;

a feedback filter that filters the reproduced signal to obtain an estimated feedback component;

a combiner that derives the reproduced signal from the receive signal at least in part by subtracting the estimated feedback component; and a controller that, subject to an adaptation rate, adjusts coefficients of the feedback filter to at least partially cancel the feedback component, the controller varying the adaption rate based at least in part on one or more proximity sensor signals.

2. The device of claim 1, wherein the speaker and microphone are packaged within a body adapted to be worn on a human ear.

3. The device of claim 2, further comprising a wireless transceiver that communicates with a mobile device to obtain the one or more proximity sensor signals.

4. The device of claim 2, further comprising at least one proximity sensor packaged within said body to provide the one or more proximity sensor signals.

5. The device of claim 1, wherein the controller uses the one or more proximity sensor signals to monitor at least one reflector distance, the controller temporarily raising the adaptation rate if the at least one reflector distance changes by more than a predetermined threshold.

6. The device of claim 1, wherein the controller uses the one or more proximity sensor signals to monitor a velocity component of at least one reflector, the controller raising the adaptation rate when the velocity component exceeds a predetermined threshold and lowering the adaptation rate when the velocity component falls below the predetermined threshold.

7. The device of claim 1, wherein the controller varies the adaptation rate by varying a parameter for calculating updated coefficients.

8. The device of claim 7, wherein the parameter is a forgetting factor.

9. The device of claim 7, wherein the parameter is a convergence factor.

10. A method for providing electronically assisted hearing, the method comprising:

providing an output signal to a speaker that supplies amplified sound;

receiving an input signal representing ambient audio that potentially includes a feedback component;

using a feedback filter to obtain an estimated feedback component from the output signal;

deriving the output signal from the input signal at least in part by subtracting the estimated feedback component;

determining an adaptation rate of the feedback filter based on one or more proximity sensor signals; and adjusting coefficients of the feedback filter using the adaptation rate.

11. The method of claim 10, wherein the input signal is received from a microphone packaged together with the speaker in a hearing aid device or wearable hearable device.

12. The method of claim 11, further comprising receiving the one or more proximity sensor signals wirelessly from a mobile device.

13. The method of claim 11, further comprising obtaining the one or more proximity sensor signals using one or more proximity sensors on the hearing aid device.

14. The method of claim 10, wherein said determining includes:

using the one or more proximity sensor signals to monitor at least one reflector distance; and temporarily raising the adaptation rate when the at least one reflector distance changes by more than a predetermined threshold.

15. The method of claim 10, wherein said determining includes:

using the one or more proximity sensor signals to monitor a velocity component of at least one reflector;

raising the adaptation rate when the velocity component exceeds a predetermined threshold; and lowering the adaptation rate when the velocity component falls below the predetermined threshold.

16. A controller for a wearable hearing device or hearing aid, the controller comprising:

a digital to analog converter that converts a digital output signal into an analog output signal for a speaker;

an analog to digital converter that converts an analog input signal from a microphone into a digital input signal that potentially includes a feedback component;

a feedback filter that filters the digital output signal to obtain an estimated feedback component;

a combiner that derives the digital output signal from the digital input signal at least in part by subtracting the estimated feedback component; and an adaptation controller that, subject to an adaptation rate, adjusts coefficients of the feedback filter to at least partially cancel the feedback component, the adaptation controller varying the adaption rate in response to one or more proximity sensor signals.

17. The controller of claim 16, further comprising a wireless transceiver that communicates with a mobile device to obtain at least one of the one or more proximity sensor signals.

18. The controller of claim 16, further comprising an interface configured to connect with at least one proximity sensor to obtain the one or more proximity sensor signals.

19. The controller of claim 16, wherein the adaptation controller uses the one or more proximity sensor signals to monitor at least one reflector distance, the adaptation controller temporarily raising the adaptation rate if the at least one reflector distance changes by more than a predetermined threshold.

20. The controller of claim 16, wherein the adaptation controller uses the one or more proximity sensor signals to monitor a velocity component of at least one reflector, the adaptation controller raising the adaptation rate when the velocity component exceeds a predetermined threshold and lowering the adaptation rate when the velocity component falls below the predetermined threshold.

* * * * *